US008556643B2

(12) United States Patent
Pevoteaux et al.

(10) Patent No.: US 8,556,643 B2
(45) Date of Patent: Oct. 15, 2013

(54) ALIGNABLE ELECTRIC CONNECTOR, AN ELECTRIC CONNECTOR SYSTEM, AND A METHOD FOR CONNECTING AN ALIGNABLE ELECTRIC CONNECTOR WITH A SECOND ELECTRIC CONNECTOR

(75) Inventors: Mark Pevoteaux, Parker, CO (US); Dennis Sims, Castle Rock, CO (US)

(73) Assignee: Norgren, Inc., Littleton, CO (US)

( * ) Notice: Subject to any disclaimer, the term of this patent is extended or adjusted under 35 U.S.C. 154(b) by 410 days.

(21) Appl. No.: 12/989,455

(22) PCT Filed: Apr. 30, 2008

(86) PCT No.: PCT/US2008/061963

§ 371 (c)(1),
(2), (4) Date: Oct. 25, 2010

(87) PCT Pub. No.: WO2009/134250

PCT Pub. Date: Nov. 5, 2009

(65) Prior Publication Data

US 2011/0045690 A1 Feb. 24, 2011

(51) Int. Cl.
*H01R 13/64* (2006.01)

(52) U.S. Cl.
USPC ..... 439/248; 439/534

(58) Field of Classification Search
None
See application file for complete search history.

(56) References Cited

U.S. PATENT DOCUMENTS

| | | | | |
|---|---|---|---|---|
| 2,502,302 | A * | 3/1950 | Arson | 439/732 |
| 4,653,835 | A | 3/1987 | Schulte et al. | |
| 4,840,585 | A | 6/1989 | Muzslay | |
| 5,407,363 | A * | 4/1995 | Polgar et al. | 439/546 |
| 5,888,093 | A * | 3/1999 | Polgar et al. | 439/546 |
| 6,017,233 | A * | 1/2000 | Fry et al. | 439/248 |
| 6,089,910 | A | 7/2000 | Suzuki et al. | |
| 7,841,886 | B2 * | 11/2010 | Klein | 439/352 |
| 2004/0077214 | A1 | 4/2004 | Turek et al. | |

FOREIGN PATENT DOCUMENTS

| | | | |
|---|---|---|---|
| DE | 3828533 | A1 | 3/1990 |
| DE | 19630960 | A1 | 2/1998 |
| EP | 1659673 | A1 | 5/2006 |

* cited by examiner

*Primary Examiner* — Michael Zarroli
(74) *Attorney, Agent, or Firm* — The Ollila Law Group LLC

(57) ABSTRACT

The present invention relates to an alignable electric connector (5), an electrical connector system, and a method for connecting an alignable electric connector (5) with a second electric connector (105). The alignable electric connector (5) is configured mount to a support structure (201) and connect with the second electric connector (105). The alignable electric connector (5) may be provided with one or more orienting structures (59, 60, 61) that mate with one or more other orienting structure (203, 110, 100) when the alignable electric connector (105) is oriented to mate with the second electric connector (105). The alignable electric connector (5) may be rotatably mounted to the support structure (201) and rotated to orient the alignable electric connector (5).

14 Claims, 8 Drawing Sheets

ALIGNABLE ELECTRIC CONNECTOR, AN ELECTRIC CONNECTOR SYSTEM, AND A METHOD FOR CONNECTING AN ALIGNABLE ELECTRIC CONNECTOR WITH A SECOND ELECTRIC CONNECTOR

FIELD OF THE INVENTION

The present invention relates to an alignable electric connector, an electric connector system, and a method for connecting an alignable electric connector with a second electric connector.

BACKGROUND OF THE INVENTION

Electric connectors are used in many electrical devices for purposes of electrical supply and transmission. For example, many electrical devices are provided with a first electric connector, for example, a plug, that connects to a second electric connector, for example, a socket. Usually, the two mating electric connectors are provided with configurations that are complementary to each other. For example, the first electric connector may include an arrangement of pins and the second electric connector may be provided with a complementary arrangement of sockets that receive the pins.

Misalignment between electric connectors may make connecting the electric connectors difficult. For example, circuit boards include a first electric connector that must align and mate with a second electric connector in a support structure. Even slight variations in the location and orientation of either of the electric connectors may make aligning the electric connectors difficult if not impossible. Misalignment between electric connectors may lead to an installer attempting to force the misaligned electric connectors together. Forcing misaligned electrical connectors together may result in damage to one or both of the electric connectors and any associated electrical devices. For example, electrical pins may bend or otherwise become misshapen. By way of yet another example, in the case of a circuit board, the circuit board may itself become damaged and may need to be replaced with a replacement circuit board. Furthermore, the same alignment difficulties may again occur when installing any such replacement circuit board.

The present invention is directed to providing an alignable electric connector, an electric connector system, and a method for connecting an alignable electric connector with a second electric connector.

SUMMARY OF THE INVENTION

The scope of the present invention is defined solely by the appended claims, and is not affected to any degree by the statements within this summary.

According to one embodiment of the present invention, an alignable electric connector comprises means for rotatably mounting the electric connector in a support structure and an electrical interface provided with means for mating with a second electric connector.

According to another embodiment of the present invention, an electric connector system comprises a support structure, an alignable electric connector rotatably mounted in the support structure, and a second electric connector that mates with the alignable electrical connector.

According to yet another embodiment of the present invention, a method for connecting an alignable electric connector and a second electric connector comprises the steps of rotating the alignable electric connector in a support structure to orient the alignable electric connector and connecting the alignable electric connector and the second electric connector.

According to still another embodiment of the present invention, an alignable electric connector comprises at least one means for mating with an orienting structure when the alignable electric connector is oriented to mate with a second electric connector and an electrical interface provided with means for mating with the second electric connector.

According to further embodiment of the present invention, an electric connector system comprises a support structure an alignable electric connector mounted in the support structure and including at least one orienting structure that mates with another orienting structure when the alignable electric connector is properly oriented and a second electric connector that mates with the alignable electrical connector.

According to yet a further embodiment of the present embodiment, a method for connecting an alignable electric connector and a second electric connector comprises the steps of mating at least one orienting structure located on the alignable electric connector with another orienting structure when the alignable electric connector is oriented to mate with the second electric connector and connecting the alignable electric connector and the second electric connector.

ASPECTS

According to one aspect of the present embodiment, an alignable electric connector comprises:

means for rotatably mounting the electric connector in a support structure; and an electrical interface provided with means for mating with a second electric connector.

Preferably, the means for mating with the second electric connector includes sockets or pins that mate with pins or sockets on the second electric connector when the alignable electric connector is properly oriented.

Preferably, the alignable electric connector further comprises at least one means for mating with an orienting structure when the alignable electric connector is properly oriented.

Preferably, the alignable electric connector further comprises first, second, and third means for mating with fourth, fifth, and sixth orienting structures when the alignable electric connector is properly oriented.

Preferably, the alignable electric connector further comprises at least one means for mating with an orienting structure when the electrical connector is properly oriented, wherein the electrical connector and second connector include sockets and pins that mate after the at least one means for mating with the orienting structure mates with the orienting structure.

Preferably, the means for mating with the second electric connector is located on the first side of the interface and a second side of the interface is provided with means for receiving or transmitting electrical power.

Preferably, the means for mating with the second electric connector is located on the first side of the interface and a second side of the interface is provided with means for mating with a third electric connector.

Preferably, the means for mating with the second electric connector is located on the first side of the interface and a second side of the interface is provided with means for connecting to wires.

Preferably, the means for rotatably mounting the electric connector in a support structure snap fits to the support structure.

Preferably, the alignable electric connector further comprises one or more torque receiving structures for rotating the electric connector.

According to another aspect of the present invention, an electric connector system comprises:

a support structure;

an alignable electric connector rotatably mounted in the support structure; and a second electric connector that mates with the alignable electrical connector.

Preferably, the alignable electric connector includes sockets or pins that mate with pins or sockets on the second electric connector when the alignable electric connector is properly oriented.

Preferably, the alignable electric connector includes at least one orienting structure that mates with another orienting structure when the alignable electric connector is properly oriented.

Preferably, the alignable electric connector includes first, second, and third orienting structures that mate with fourth, fifth and sixth orienting structures when the alignable electric connector is properly oriented.

Preferably, the alignable electric connector includes at least one orienting structure that mates with another orienting structure when the alignable electric connector is properly oriented and the electrical connector and second connector include sockets and pins that mate after the at least one orienting structure mates with the another orienting structure.

Preferably, the alignable electric connector includes an interface provided with a first side that mates with the second electric connector and a second side that receives or transmits electrical power.

Preferably, the alignable electric connector includes an interface provided with a first side that mates with the second electric connector and a second side that mates with a third electric connector.

Preferably, the alignable electric connector includes an interface provided with a first side that mates with the second electric connector and a second side that connects to wires.

Preferably, the alignable electric connector is rotatably mounted in the support structure via a snap fit.

Preferably, the alignable electric connector includes one or more torque receiving structures for rotating the electric connector.

According to another aspect of the present invention, a method for connecting an alignable electric connector and a second electric connector comprises the steps of:

rotating the alignable electric connector in a support structure to orient the alignable electric connector; and connecting the alignable electric connector and the second electric connector.

Preferably, the alignable electric connector and the second electric connector include sockets and pins that mate when the alignable electric connector and the second electric connector are connected.

Preferably, the alignable electric connector includes at least one orienting structure and further comprising the step of mating the at least one orienting structure with another orienting structure when the alignable electric connector is properly oriented.

Preferably, the alignable electric connector includes first, second, and third orienting structures and further comprising the steps of mating the first, second, and third orienting structures with fourth, fifth, and sixth orienting structures when the alignable electric connector is properly oriented.

Preferably, the alignable electric connector includes at least one orienting structure and sockets or pins that mate with pins or sockets on the second electric connector when the alignable electric connector is properly oriented and further comprising the steps of:

mating the at least one orienting structure with another orienting structure when the alignable electric connector is properly oriented; and mating the sockets and pins after the at least one orienting structure mates with the another orienting structure.

Preferably, the alignable electric connector includes an interface provided with a first side that mates with the second electric connector and a second side that receives or transmits electrical power.

Preferably, the alignable electric connector includes an interface provided with a first side that mates with the second electric connector and a second side that mates with a third electric connector.

Preferably, the alignable electric connector includes an interface provided with a first side that mates with the second electric connector and a second side that connects to wires.

Preferably, the alignable electric connector is rotatably mounted in the support structure via a snap fit.

Preferably, the alignable electric connector includes one or more torque receiving structures for rotating the electric connector.

According to another aspect of the present invention, an alignable electric connector comprises:

at least one means for mating with an orienting structure when the alignable electric connector is oriented to mate with a second electric connector; and an electrical interface provided with means for mating with the second electric connector.

Preferably, the means for mating with the second electric connector includes sockets or pins that mate with pins or sockets on the second electric connector when the alignable electric connector is properly oriented.

Preferably, the alignable electric connector further comprises first, second, and third means for mating with fourth, fifth, and sixth orienting structures when the alignable electric connector is properly oriented.

Preferably, the electrical connector and second connector include sockets and pins that mate after the at least one means for mating with the orienting structure mates with the orienting structure.

Preferably, the means for mating with the second electric connector is located on the first side of the interface and a second side of the interface is provided with means for receiving or transmitting electrical power.

Preferably, the means for mating with the second electric connector is located on the first side of the interface and a second side of the interface is provided with means for mating with a third electric connector.

Preferably, the means for mating with the second electric connector is located on the first side of the interface and a second side of the interface is provided with means for connecting to wires.

According to another aspect of the present invention, an electric connector system comprises:

a support structure;

an alignable electric connector mounted in the support structure and including at least one orienting structure that mates with another orienting structure when the alignable electric connector is properly oriented; and a second electric connector that mates with the alignable electrical connector.

Preferably, the alignable electric connector includes sockets or pins that mate with pins or sockets on the second electric connector when the alignable electric connector is properly oriented.

Preferably, the alignable electric connector includes first, second, and third orienting structures that mate with fourth, fifth and sixth orienting structures when the alignable electric connector is properly oriented.

Preferably, the electrical connector and second connector include sockets and pins that mate after the at least one orienting structure mates with the another orienting structure.

Preferably, the alignable electric connector includes an interface provided with a first side that mates with the second electric connector and a second side that receives or transmits electrical power.

Preferably, the alignable electric connector includes an interface provided with a first side that mates with the second electric connector and a second side that mates with a third electric connector.

Preferably, the alignable electric connector includes an interface provided with a first side that mates with the second electric connector and a second side that connects to wires.

According to another aspect of the present embodiment, a method for connecting an alignable electric connector and a second electric connector comprises the steps of:

mating at least one orienting structure located on the alignable electric connector with another orienting structure when the alignable electric connector is oriented to mate with the second electric connector; and connecting the alignable electric connector and the second electric connector.

Preferably, the alignable electric connector and the second electric connector include sockets and pins that mate when the alignable electric connector and the second electric connector are connected.

Preferably, the alignable electric connector includes first, second, and third orienting structures and further comprising the steps of mating the first, second, and third orienting structures with fourth, fifth, and sixth orienting structures when the alignable electric connector is oriented to connect with the second electric connector.

Preferably, the alignable electric connector includes sockets or pins that mate with pins or sockets on the second electric connector when the alignable electric connector is properly oriented and further comprising the step of mating the sockets and pins after the at least one orienting structure mates with the another orienting structure.

Preferably, the alignable electric connector includes an interface provided with a first side that mates with the second electric connector and a second side that receives or transmits electrical power.

Preferably, the alignable electric connector includes an interface provided with a first side that mates with the second electric connector and a second side that mates with a third electric connector.

Preferably, the alignable electric connector includes an interface provided with a first side that mates with the second electric connector and a second side that connects to wires.

DETAILED DESCRIPTION OF THE PRESENTLY PREFERRED EMBODIMENT

FIGS. 1-4 show an alignable electric connector 5 according to one embodiment. According to one aspect of the present embodiment, the alignable electric connector 5 is configured to mount to a support structure 201, for example, and not limitation, the wall of valve sub-base shown in FIG. 6. According to another aspect of the present embodiment, the alignable electric connector 5 is configured to align with and connect with at least one other electric connector 105, for example, and not limitation, the electric connector 105 on the circuit board 100 installed in the valve sub-base shown in FIG. 6.

Figure 1:
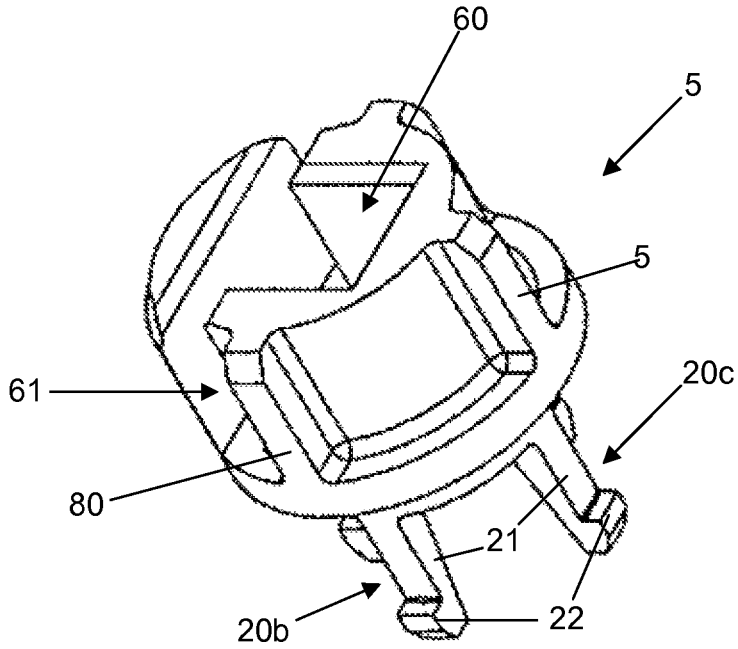
FIG. 1 depicts perspective view of an alignable electric connector according to an embodiment.
Figure 2:
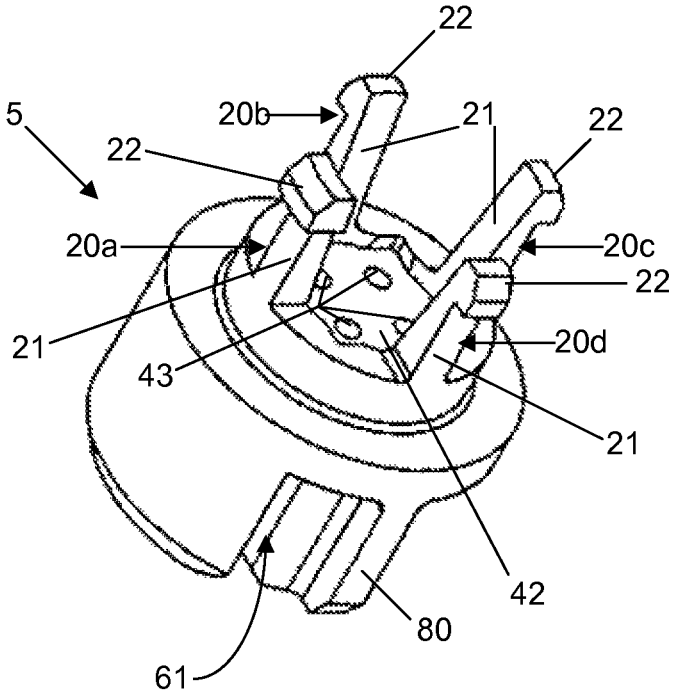
FIG. 2 depicts perspective view of an alignable electric connector according to an embodiment.

As shown in FIGS. 1, 2, and 4, the alignable electric connector 5 is preferably provided with a plurality of retaining members 20*a*-20*d*. According to one aspect of the present embodiment, the retaining members 20*a*-20*d* mount the alignable electric connector 5 to the support structure 201. The retaining members 20*a*-20*d* of the present embodiment preferably snap fit to an opening 202 of the support structure 201. As shown, the retaining members 20*a*-20*d* preferably include a plurality of flexible stems 21 and hooks 22 located at the ends to the stems 21.

Figure 6:
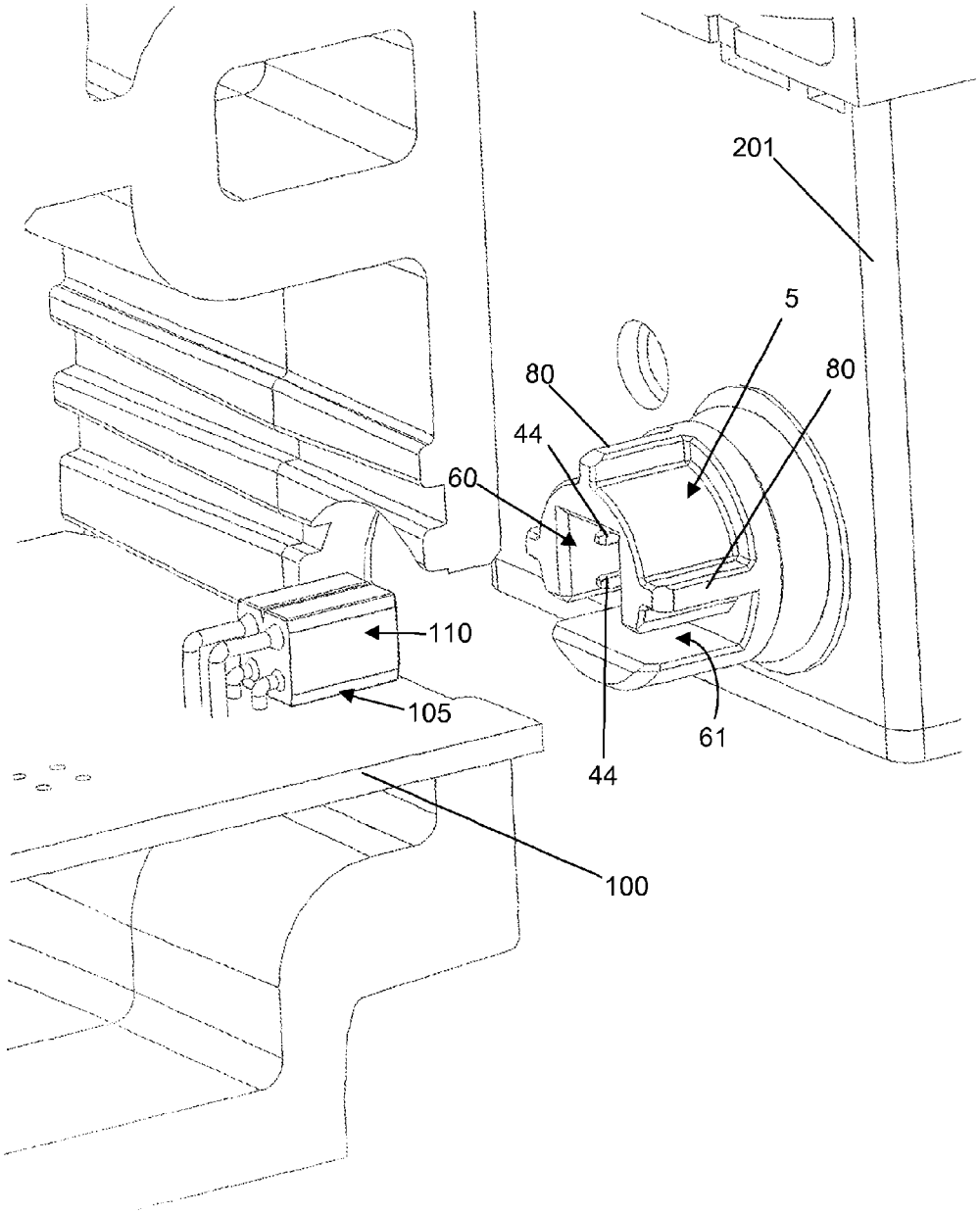
FIG. 6 depicts perspective view of an alignable electric connector and a second electric connector according to an embodiment.

According to another aspect of the present embodiment, the alignable electric connector 5 is configured to align and mate with at least one other electric connector, for example the second electric connector 105 on the circuit board 100 shown in FIG. 6. Those of ordinary skill in the art will appreciate that it is within the scope of the present invention to connect the alignable electric connector 5 to any type of electric connector and not just the second electric connector 105 on the circuit board 100 shown in FIG. 6.

The alignable electric connector 5 and the second electric connector 105 are provided with conductive elements, for example, and not limitation, conductive pins and sockets, that all electrical supply and transmission to occur between the connectors 5, 105. As shown in FIGS. 3, 5A, 5B, and 6, the alignable electric connector 5 includes an electrical interface 40 provided with a first side 41. In the present embodiment, the first side 41 of the interface 40 connects to a second electric connector, for example, and not limitation, the second electric connector 105 of the circuit board 100 shown in FIG. 6.

Figure 3:
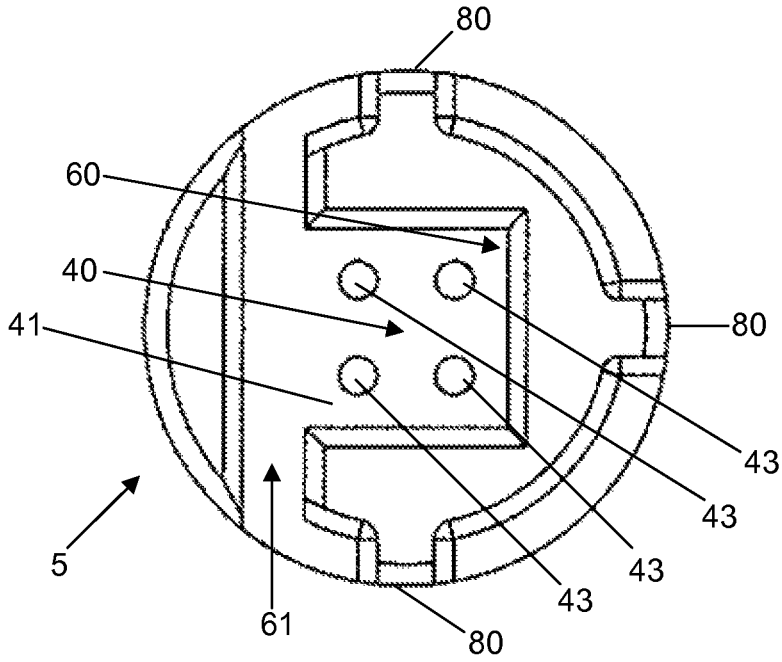
FIG. 3 depicts perspective view of an alignable electric connector according to an embodiment.

As shown in FIG. 3, the first side 41 of the electrical interface 40 may include pin sockets 43 that receive a plurality of conductive pins (not shown) provided on the second electric connector, for example, second electric connector 105. Alternatively, as shown in FIG. 6, the first side 41 of the electrical interface 40 may include conductive pins 44 that are received with pin sockets (not shown) provided on the second electric connector, for example, second electric connector 105.

Regardless of whether the conductive pins are located on the first side 41 of alignable electric connector 5 or the second electric connector, those of ordinary skill in the art will appreciate that it is within the scope of the present embodiment to utilize any number of pins and to arrange the pins in any configuration. Additionally, within the scope of the present embodiment, the pins may be of different sizes and different shapes. Furthermore, although in the embodiment depicted in FIG. 6 the first side 41 transmits power to the electrical circuit 105 on the circuit board 100, those of ordinary skill in the art will appreciate that in alternative embodiments the first side 41 may receive electrical power from a second electric connector.

Figure 4A:
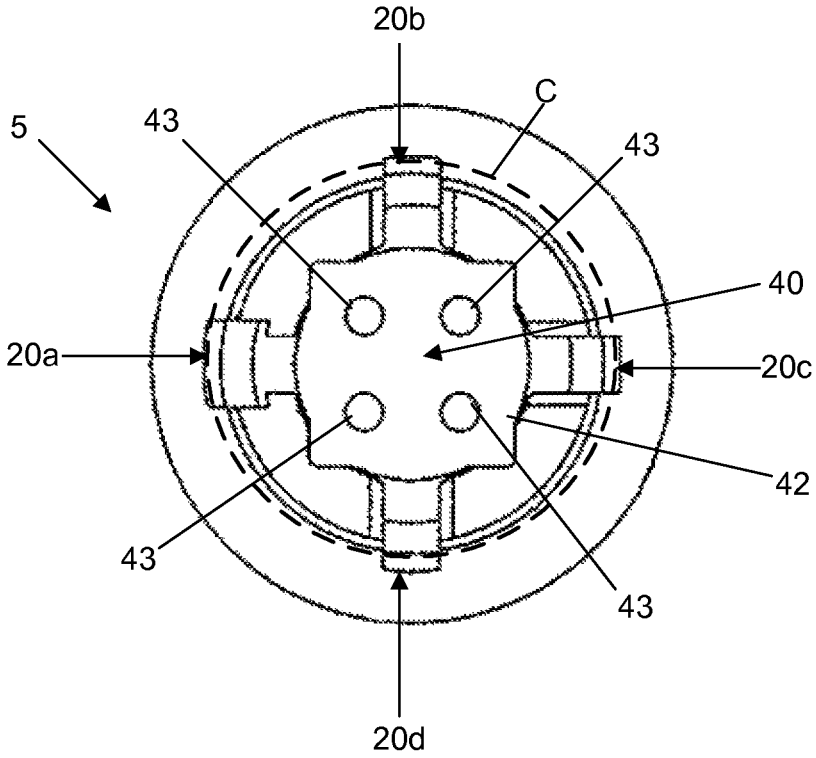
FIG. 4A depicts perspective view of an alignable electric connector according to an embodiment.

As shown FIGS. 2 and 4A, the electrical interface 40 is also provided with a second side 42. The second side 42 of the electrical interface 40 is configured to receive or transmit electrical power. For example, and not limitation, in the embodiment depicted in FIG. 6, the second side 42 may supply electrical power to the alignable electric connector 5, which, in turn, supplies power to the circuit board 100 via the first side 41 of the electrical interface 40.

The second side 42 may connect to wires (not shown), for example by fastening or soldering wires to the interface 40. Alternatively, the second side 42 may connect to a third electric connector (not shown) that mates with the second side 42 of the electrical interface 40. For example, and not limitation, the second side 42 may have an arrangement of conductive pins (not shown) that fit into corresponding pin sockets 43 on the third electric connector (not shown). By way of yet another example, the second side 42 of electrical interface 40 may have an arrangement of sockets 43 that receive pins (not shown) provided on the third electric connector (not shown).

As shown, the alignable electric connector 5 preferably includes one or more orienting structures configured to mate with one or more other orienting structures when the alignable electric connector 5 is properly oriented. By way of example, the alignable electrical connector 5 may be provided with a first orienting structure 59 that is configured to mate with a fourth orienting structure 203 provided on the support structure 201.

Figure 4B:
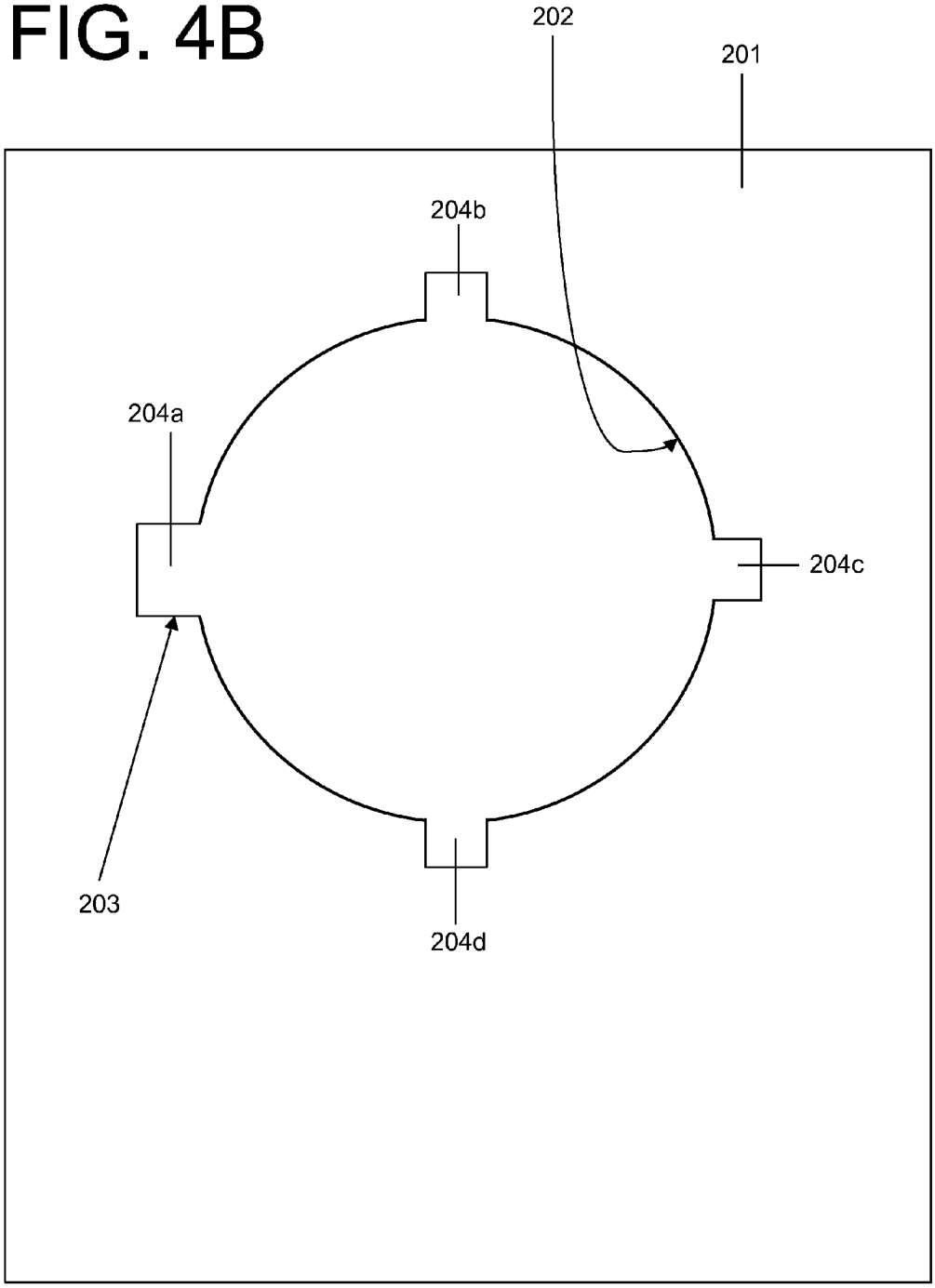
FIG. 4B depicts a perspective view of an opening in a support structure according to an embodiment.

As shown in FIGS. 4A and 4B, the first orienting structure 59 may include retaining members 20*a*-20*d* and the fourth orienting structure 203 may include cutouts 204*a*-204*d* in the opening 202 of the support structure 201. In the present embodiment, each cutout 204*a*, 204*b*, 204*c*, and 204*d* functions as a keyway that mates with a generally complementary retaining member 20*a*, 20*b*, 20*c*, or 20*d* during installation of the alignable electric connector 5 in the support structure 201. Advantageously, in this manner, the geometry or location of retaining members 20*a*-20*d* and cutouts 204*a*-204*d* may be selected so the alignable electric connector 5 can be installed in the support structure 201 in a properly oriented position. Advantageously, in this manner, the geometry or location of the retaining members 20*a*-20*d* and cutouts 204*a*-204*d* may be selected so that the alignable electric connector 5 cannot be installed in the support structure 2101 in an improper oriented position.

By way of example, and not limitation, in the embodiment shown in FIGS. 4A-4B, the retaining member 20*a* and cutout 204*a* may be enlarged with respect to the other retaining members 20*b*-20*d* and cutouts 204*b*-204*d*. In this manner, when the alignable electric connector 5 is properly oriented, the enlarged retaining member 20*a* and cutout 204*a* mate and the alignable electric connector 5 can be mounted to the support structure 201; whereas when the alignable electric connector 5 is improperly oriented, the enlarged retaining member 20*a* will not fit into the smaller cutouts 204*b*-204*d*, and the alignable electric connector 5 cannot be mounted to the support structure 201.

Those of ordinary skill in the art will appreciate that additional or alternative orienting structures may be provided on the alignable electric connector 5. By way of yet another example, as shown in FIGS. 1, 3, and 6, the connector 5 may include a second orienting structure 60. According to one aspect of the present embodiment, the second orienting structure 60 may be configured to orient the alignable electric connector 5 by mating with a fifth orienting structure 110 on the second electric connector 105 when the alignable electric connector 5 is properly oriented. According to another aspect of the present embodiment, the second orienting structure 60 may be configured to orient the second electric connector 205 by mating with a fifth orienting structure 110 on the second electric connector 105 when the second electric connector 105 is properly oriented.

By way of still yet another example, the alignable electric connector 5 may be provided with a third orienting structure 61. According to one aspect of the present embodiment, the third orienting structure 61 may be configured to orient the alignable electric connector 5 by mating with a sixth orienting structure 110, for example, a circuit board 100, that includes the second connector 105. According to one aspect of the present embodiment, the third orienting structure 61 may be configured to orient the second electric connector 105 by mating with a sixth orienting structure 110, for example, a circuit board 100, that includes the second connector 105.

Those of ordinary skill in the art will appreciate that it is within the scope of the present embodiment to fabricate the alignable electric connector 5 without an orienting structure. Furthermore, although various examples of possible orienting structures 59, 60, and 61 have been shown, those of ordinary skill in the art will appreciate that it is within the scope of the present embodiment to provide the alignable electric connector 5 with other configurations that mate with a variety of structures. For example, and not limitation, where a stack of circuit boards 100 are provided, the alignable electric connector 5 may be provided with a stack or other arrangement of orienting structures 61 that mate with the circuit boards 100 when the alignable electric connector 5 is properly oriented.

Preferably, the one or more orienting structures, for example, and not limitation 59, 60, 61, on the connector 5, mate with one or more other orienting structures, for example, and not limitation, 203, 110, 100, before the conductive pins on the electric connectors 5 or 105 mate with the corresponding sockets on the other electric connector 5 or 105. Advantageously, this arrangement may prevent damage to the conductive pins, for example 44, from misalignment with the sockets. By way of example, and not limitation, as shown in FIG. 6, the conductive pins 44 on alignable electric connector 5 may be recessed within the orienting structure 60, such that orienting structure 60 mates with orienting structure 110 on electric connector 105 before conductive pins 44 mate with the sockets (not shown) on the electric connector 105.

Although, in the embodiment shown in FIG. 4B, the cutouts 204*a*-204*d* in the opening 202 of the support structure 201 may advantageously function to prevent rotation of the alignable electric connector 5 relative to the support structure 201, in alternative embodiments the alignable electric connector 5 may mount to a support structure 201 in a manner that allows the alignable electric connector 5 to be reoriented while mounted in the support structure 201.

As shown in FIG. 4, the retaining members 20 may be arranged so that each lies on the periphery of an imaginary circle C. In this manner, when the alignable electric connector 5 is mounted into a generally circular opening 202 of the support structure 201, the alignable electric connector 5 may rotate about the imaginary circle C. In order to rotate the alignable electric connector 5, torque may be applied to one or more torque receiving structures. The torque receiving structure may be positioned so that it is accessible on either side of the opening 202. For example, and not limitation, the alignable electric connector 5 may be provided with torque receiving structures, for example, and not limitation, ribs 80 (FIGS. 1-3 and 6), located on a first side of the opening 202 when the alignable electric connector 5 is installed in the support structure 201. By way of yet another example, and not limitation, the alignable electric connector 5 may be provided with torque receiving structures, for example, and not limitation, hooks 22 on the retaining members 20, located on a second side of the opening 202 when the connector 5 is installed in the support structure 201. Those of ordinary skill in the art will appreciate that it is within the scope of the present embodiment to provide other configurations for rotating the alignable electric connector 5 as well.

Figure 5A:
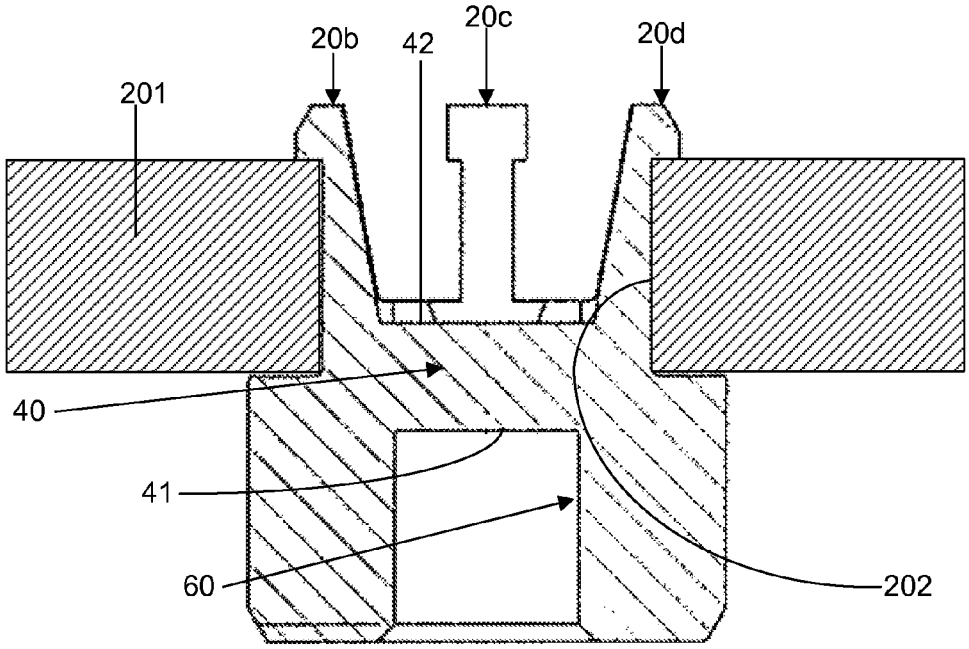
FIG. 5A depicts sectional view of an alignable electric connector according to an embodiment
Figure 5B:
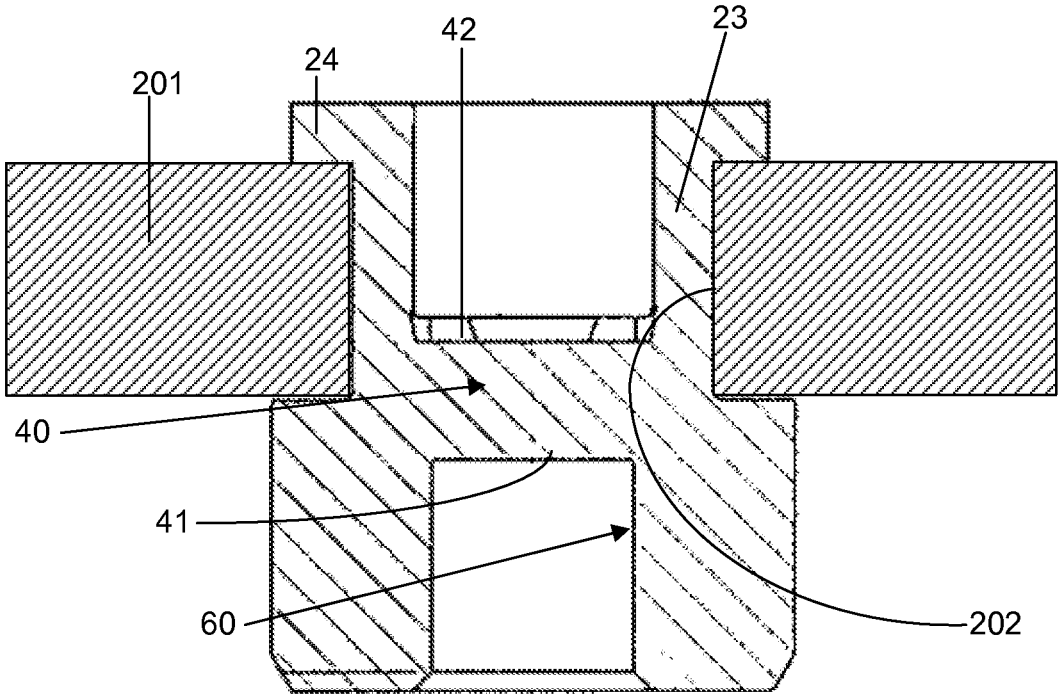
FIG. 5B depicts sectional view of an alignable electric connector according to an embodiment

Those of ordinary skill in the art will appreciate that present embodiment may, within the scope of the present invention, use other means for rotatably mounting the alignable electric connector 5 to the support structure 201. For example, and not limitation, as shown in FIG. 5B, the alignable electric connector 5 may include a cylindrical member 23 that extends through an opening 202 of the support structure 201 and is then deformed to provide a retaining collar 24 that holds the alignable electric connector 5 in the opening 202.

Although the alignable electric connector 5 may be provided with a geometry that allows the alignable electric connector 5 to reorient and rotate while mounted in the support structure 201, in alternative embodiments, the position of the electric connector 5, with respect to the support structure 201, may be fixed while the alignable electric connector 5 is mounted to the support structure 201. For example, and not limitation, in certain embodiments, for example the embodiment shown in FIG. 4B the opening 202 of the support structure 201 may be provided with a shape that prevents rotation, for example, and not limitation, a non-circular opening that includes cutouts 204*a*-204*d*.

Those of ordinary skill in the art will appreciate that the connector 5 may be fabricated from any number of materials, for example, and not limitation, a plastic, metal, ceramic, a glass, or fiberglass. In the present embodiment, the connector 5 may be molded and fabricated from fiberglass and a thermoplastic polyester resin, for example, and not limitation, Crastin® SK605 and BK503 resins manufactured by Dupont®.

The present description depicts specific examples to teach those skilled in the art how to make and use the best mode of the invention. For the purpose of teaching inventive principles, some conventional aspects have been simplified or omitted. Those skilled in the art will appreciate variations from these examples that fall within the scope of the invention. For example, it should be apparent to those skilled in the art that it is within the scope of the present invention to use the principals discussed herein in conjunction with connectors any type of electrical devices, and not just as a connectors 5, 105 used to supply power to a circuit board 100. The detailed descriptions of the above embodiments are not exhaustive descriptions of all embodiments contemplated by the inventors to be within the scope of the invention.

Persons skilled in the art will recognize that certain elements of the above-described embodiments may variously be combined or eliminated to create further embodiments, and such further embodiments fall within the scope and teachings of the invention. It will also be apparent to those of ordinary skill in the art that the above-described embodiments may be combined in whole or in part to create additional embodiments within the scope and teachings of the invention.

Thus, although specific embodiments of, and examples for, the invention are described herein for illustrative purposes, various equivalent modifications are possible within the scope of the invention, as those skilled in the relevant art will recognize. The teachings provided herein may be applied to other embodiments than those described above and shown in the accompanying figures. Accordingly, the scope of the invention is determined from the following claims.

We claim:

1. A self-aligning electric connector system, comprising:

a support structure (201) including an opening (202) configured to receive a self-aligning electric connector (5);

a second electric connector (105) located on a circuit board (100); and the self-aligning electric connector (105) configured to be affixed in the as opening (202) of the support structure (201), with the self-aligning electric connector (5) comprising:

an electrical interface (40) extending from a first side (41) self-aligning electric connector (5) to a second side (42), with the electrical interface (40) configured to receive a first plurality of electrical conductors at the first side (41) and configured to receive a second plurality of electrical conductors at the second side (42);

a plurality of flexible retaining members (20*a*-20*d*) extending from the second side (42) and configured to engage the opening (202), with one predetermined flexible retaining member (20*a*) of the plurality of flexible retaining members (20*a*-20*d*) being larger in size and functioning as a first orienting structure with respect to the support structure (201);

a second orienting structure (60) on the first side (41) and configured to fit to the second electric connector (105) at a predetermined connector orientation; and a third orienting structure (61) formed on the first side (41) and configured to fit to the circuit board (100) at the redetermined connector orientation.

2. The self-aligning electric connector system of claim 1, wherein the self-aligning electric connector (5) is configured to fit to the support structure (201) at a predetermined structure orientation.

3. The self-aligning electric connector system of claim 1, wherein the plurality of flexible retaining members (20*a*-20*d*) of the self-aligning electric connector (5) are configured to fit to the support structure (201) at a predetermined structure orientation.

4. The self-aligning electric connector system of claim 1, wherein the self-aligning electric connector (5) is configured to snap-fit to the support structure (201).

5. The self-aligning electric connector system of claim 1, wherein the plurality of flexible retaining members (20*a*-20*d*) prevent rotation of the self-aligning electric connector (5) with respect to the support structure (201) when the self-aligning electric connector (5) is substantially in place in the opening (202).

6. The self-aligning electric connector system of claim 1, wherein the plurality of flexible retaining members (20*a*-20*d*) prevent rotation of the self-aligning electric connector (5) with respect to the support structure (201) when the self-aligning electric connector (5) is substantially in place in the opening (202), with the self-aligning electric connector (5) further comprising one or more torque receiving structures (80) for rotating the self-aligning electric connector (5) during installation.

7. The self-aligning connector system of claim 1, with the second orienting structure (60) of the self-aligning electric connector (5) comprising a shaped receptacle (60) configured to fit to the second electric connector (105) at the predetermined connector orientation.

8. The self-aligning electric connector system of claim 1, with the third orienting structure (61) comprising a slot (61) configured to fit to the circuit board (100) at the predetermined connector orientation.

9. A method for connecting a self-aligning electric connector and a second electric connector, comprising the steps of:

aligning the self-aligning electric connector with an opening in a support structure, with the self-aligning electric connector being rotationally oriented at a predetermined structure orientation with respect to the opening;

inserting the self-aligning electric connector partially into the opening, wherein a plurality of flexible retaining members of the self-aligning electric connector engage the opening;

bringing the support structure and the self-aligning electric connector into engagement with a second electric connector affixed to a circuit board, with the self-aligning electric connector and the support structure being rotationally oriented at a predetermined connector orientation with respect to the second electric connector; and inserting the electric connector into substantial engagement with the second electric connector, wherein a second orienting structure of the self-aligning electric connector aligns with the second electric connector and wherein a third orienting structure of the self-aligning electric connector aligns with the circuit board.

10. The method of claim 9, wherein the plurality of flexible retaining members of the self-aligning electric connector are configured to fit to the support structure at a redetermined structure orientation.

11. The method of claim 9, wherein the self-aligning electric connector is configured to snap-fit to the support structure.

12. The method of claim 9, wherein the plurality of flexible retaining members prevent rotation of the self-aligning electric connector with respect to the support structure when the self-aligning electric connector is substantially in place in the opening.

13. The method of claim 9, with the second orienting structure of the self-aligning electric connector comprising as shaped receptacle configured to fit to the second electric connector at the predetermined connector orientation.

14. The method of claim 9, with the third orienting structure comprising a slot configured to fit to the circuit board at the predetermined connector orientation.

* * * * *